US007656361B2

(12) United States Patent
Franco Garcia

(10) Patent No.: US 7,656,361 B2
(45) Date of Patent: Feb. 2, 2010

(54) MULTIPLE PHASE SHIFTER FOR PROTECTING INDIVIDUALS AGAINST ELECTROMAGNETIC WAVES

(76) Inventor: Abel Franco Garcia, 42, rue de la Pannerie, Halluin (FR) 59250

( * ) Notice: Subject to any disclaimer, the term of this patent is extended or adjusted under 35 U.S.C. 154(b) by 145 days.

(21) Appl. No.: 11/990,866

(22) PCT Filed: Aug. 21, 2006

(86) PCT No.: PCT/FR2006/001963

§ 371 (c)(1),
(2), (4) Date: Apr. 3, 2008

(87) PCT Pub. No.: WO2007/023220

PCT Pub. Date: Mar. 1, 2007

(65) Prior Publication Data

US 2008/0231534 A1 Sep. 25, 2008

(51) Int. Cl.
*H01Q 7/04* (2006.01)

(52) U.S. Cl. ..... 343/842; 343/748; 343/742; 343/867; 250/515.1

(58) Field of Classification Search ..... 343/841, 343/842, 748, 742, 867; 250/515.1
See application file for complete search history.

(56) References Cited

U.S. PATENT DOCUMENTS 6,011,523 A 1/2000 Pobo et al.
6,894,658 B2 * 5/2005 Franco ..... 343/867
2003/0006384 A1 * 1/2003 Masaki et al. ..... 250/505.1
2005/0140564 A1 * 6/2005 Deguchi et al. ..... 343/866

FOREIGN PATENT DOCUMENTS

| | | | |
|---|---|---|---|
| EP | 1 278 267 | A | 1/2003 |
| FR | 2 781 088 | A | 1/2000 |
| FR | 2 860 106 | A | 3/2005 |
| JP | 2001-284881 | A | 10/2001 |

* cited by examiner

*Primary Examiner*—Hoang V Nguyen
(74) *Attorney, Agent, or Firm*—Kenyon & Kenyon LLP

(57) ABSTRACT

The invention relates to a multiple phase shifter for protecting individuals against electromagnetic waves. The invention comprises several phase shift modules which each comprise two identical or homothetic flat loops which are electrically connected by means of two inter-loop connection elements at a first opening in each of the loops and which are electrically insulated from one another with the exception of the inter-loop connection elements. Each module is electrically connected to another module by means of two inter-module connection elements and is essentially identical or homothetic to the other modules. The inter-module connection elements connect one of the loops of one module at a second opening in the loop to one of the loops of another module at a second opening in said loop. The modules are electrically insulated from one another with the exception of the inter-module connection elements.

8 Claims, 2 Drawing Sheets

MULTIPLE PHASE SHIFTER FOR PROTECTING INDIVIDUALS AGAINST ELECTROMAGNETIC WAVES

This is a 371 national phase application of PCT/FR2006/001963 filed 21 Aug. 2006, claiming priority to French Patent Application No. FR 0508722 filed 24 Aug. 2005, the contents of which are incorporated herein by reference.

FIELD OF THE INVENTION

The subject of this present invention is a multiple phase shifting device for the protection of people in relation to electromagnetic waves. Its area of application is in the field of personal protection in relation to the waves emitted by mobile telephones for example.

BACKGROUND OF THE INVENTION

The appearance and the commercial development of mobile telephones and microwave ovens, as well as rapid growth in radio and television stations, mean that people live in an increasingly dense electromagnetic fog.

Similarly to what has happened in the x-ray protection area, the difficulty of seeing such electromagnetic waves has led to a serious requirement in society for information and protection.

The question of any incidence of mobile telephony on the health of individuals has caused much controversy over many years.

One of the difficulties concerns the measurement of specific absorption flow (SAF), or the power absorbed in watts per kilogram of living tissue. SAF measurements in vivo are naturally not possible by probes sensitive to the electric field or to temperature.

Medical magnetic resonance imagery (MRI) and numerical methods for electromagnetic calculation allow estimation of the electric and magnetic fields, but it is difficult to modelize a radiotelephone numerically (see FTRD, France Telecom, ENST models).

The calculations performed in accordance with the existing models for GSM give an SAF of 1 watt/kilogram, with 13% of this power being absorbed by the brain, 30% of the energy being absorbed in a 5 cm cube centred on the inner ear, and the maximum estimated SAF in the inner ear being of the order of 0.4 watts/kg for a power of 250 mW and at a GSM frequency of 900 MHz.

Although the SAF measurements give rise to an uncertainty level of 35%, the European national regulations make use of it, since the SAF is the only measurable physical parameter that is recognised unanimously by the technical and scientific community regarding the effects on health of the electromagnetic fields of the GSM system.

Thus, the maximum peak power authorised in France for GSM is 2 watts at 900 MHz and 1 watt at 1800 MHz, with TDMA chopping at 217 Hertz, and the maximum allowable SAF being set to 0.08 watts/kg for the public (regulation 1999/519CE) with 2 watts/kg locally per 10 grams of tissue.

By way of guidance only, a mean conductivity value of 1 S/m for tissue, at 900 MHz, gives an electric field strength of 30 V/m to get an SAF of 1 W/kg.

The electromagnetic fields associated with mobile telephony at between 850 and 1900 MHz have an apparently low thermal effect (less than 0.1 degrees).

A large number of studies have been conducted on the effects on health of these waves:

the cardiovascular system (blood pressure, heart rate), cancers (glioma, meninglioma, neurinoma of the hearing, cancers of the parotid glands, etc.), embryonic reproduction and development, The immune system (IgA) and the endocrinal system (melatonin, cortisol), cognitive functions such as memory, attention, concentration, sleep, headache, epilepsy, etc., hematoencephalic barrier, thermal shock protein.

Studies have concerned the symptoms that cannot be quantified by a physician (fatigue, sensation of heat, irritability, vertigo, etc.).

It is only with difficulty that these epidemiological studies can be affirmative regarding the impact of mobile telephony on the health of individuals, to the extent, in particular, that one cannot even consider setting up double-blind testing.

Several written articles in the popular scientific press have also suggested the potentially harmful effect of electromagnetic waves.

The major national media, especially in France, regularly raise this question, as for example in the Le Monde daily on 11 Sep. 1996, 10 Mar. 1999, 30 Jan. 2001, and 28 Mar. 2002.

A very large number of patent applications have already been submitted for devices aiming to protect users from cellular phones (see European classes H01Q1/24A1C and H04B1/38P2E).

Reference can be made, for example, to documents WO-03/005487, FR2.826.784, FR-2.781.088, WO-03/043122, and WO-2005/031918, some of which were originated by this present inventor.

The protection devices known from the prior art, such as those described in document WO-2005/031918, nevertheless have the drawback of having a very small radius of action. In fact, this ranges from a few millimeters to one centimeter only.

So there exists a need for the protection of people in relation to the waves emitted by emitters (or transmitters) within several meters, or even several tens of meters, of where people are located. This is the case, for example, of mobile telephone relay stations, which can be located close to residential areas.

The problem that then arises is therefore how to provide a device for the protection of people in relation to electromagnetic waves that have an effect over large distances of up to several tens of meters.

SUMMARY OF THE INVENTION

The purpose of the invention is therefore to provide a solution to the aforementioned problems, amongst others.

The invention therefore relates to a multiple phase shifting device for the protection of people in relation to electromagnetic waves.

Characteristically, the device includes several phase-shifting modules. In its turn, each phase-shifting module includes at least two loops which are substantially the same or homothetic to each other, substantially flat, and connected to each other electrically by two separate inter-loop connecting elements, at a first opening in each of the loops. These loops are electrically insulated from each other with the exception of the inter-loop connecting elements.

In addition, each of the phase-shifting modules is connected electrically, by two separate inter-module connecting elements, to at least one other of the phase-shifting modules, and is substantially the same or homothetic to the other phase-shifting modules.

Furthermore, the inter-module connecting elements each connect one of the loops of one of the phase-shifting modules at a second opening in this loop, to one of the loops of another of the phase-shifting modules at a second opening in that loop.

Finally, the phase-shifting modules are electrically insulated from each other with the exception of the inter-module connecting elements.

In a first variant, the loops of at least one of the phase-shifting modules are placed in two different planes.

These different planes are then preferably substantially parallel to each other.

In another variant, the loops of at least one of the phase-shifting modules are positioned in the same plane.

It can be that the plane of the loops in a phase-shifting module is the same as the plane of the loops in another phase-shifting module.

In another variant, possibly in combination with any of the previous ones, the plane or planes of the loops in a phase-shifting module are different from the plane or planes of the loops in another phase-shifting module.

The plane or planes of the loops in one phase-shifting module are then preferably parallel to the plane or planes of the loops in another phase-shifting module.

In yet another variant, possibly in combination with any of the previous ones, each of the loops is mounted on a flexible printed circuit and covered with a flexible insulating sheet in a polymer material.

This present inventor has so far been unable to explain the physical mechanisms that are acting in the invention that has just been presented, and that will now be explained in detail.

It appears, but could not be verified by this present inventor, that each phase-shifting module of the invention does not include an antenna properly speaking (by comparison, see documents U.S. Pat. No. 5,627,552, U.S. Pat. No. 3,582,951 and U.S. Pat. No. 5,451,965) of the folded-hertz dipole or Yagi type, or indeed of the magnetic loop type.

Furthermore, like all those involved in the occupation concerned, this present inventor has encountered significant difficulties in the conduct of SAF measurements that would allow the beneficial effects of this device to be demonstrated.

This present inventor has discovered that the BEST MSA 21 type B class 2 series 1455 appliance from Intertek Testing Services, which performs measurements by electro-acupuncture at points located on the hand of the patient, allows the display and measurement of an effect of this present invention, where this effect is improved in relation to those obtained with previous devices, in particular those described in documents WO-03/005487, FR-2.826.784 and FR-2.781.088 and WO-2005/031918.

In order to perform measurements with the BEST MSA 21 appliance, the following protocol was observed:

1) verification of the electric and magnetic fields and electromagnetic waves in the test area by means of a low-frequency field measuring set (1 Hz to 2000 Hz) of Krystal M 840 D make, Faditech Z 5000 modified type, a wideband high-frequency field measuring set (23 MHz to 16 GHz) of the Faditech L.B series 683 type, and of a screened probe designed for the aforementioned Z 5000.

By way of guidance only, during the tests, the value of the electric field (E) at 50 Hz was of the order of 2 V/m, that of the magnetic field at 50 Hz was less than 0.01 nT, and the electromagnetic waves not detectable in the FM, VHF, UHF and micro-waves bands, with a value of 0.1 mW being measured for the short waves from 23 to 88 MHz.

During these measurements, the mobile telephones of the people present were switched off.

The local SHF power density in the air measured with the HFR1 detector from ROM Elektronik was 0.30 W/m2.

2) measurement, with the BEST MSA 21 type B class, series 1455 appliance fitted with a copper mass held in the hand of the patient and an electro-acupuncture probe, in the following states:

the neutral state, the mobile-on state, held within 50 cm of the head of a tested individual, the mobile-on state, held at the ear by the tested individual, the mobile-on state, with the device of this present invention fitted to the mobile telephone or placed between the telephone and the hand of the tested individual holding the copper mass.

This present inventor has been able to verify the greater effectiveness of this present invention in relation to the earlier devices, using the following instruments:

BICOM from Regumed Lochhamer Schiag, S.A;

VEGATEST EXPERT from Vega AM Hohenstein;

PROGNOS from MedPrevent GmbH & Co;

PRT 2000S from Biomeridian.

This present inventor has also been able to verify the effectiveness of the multiple phase shifting device of the invention in terms of its radius of action. In fact the latter was increased by a factor that can range from 100 to 3000, depending on the number of phase-shifting modules, in relation to a conventional device.

BRIEF DESCRIPTION OF THE DRAWINGS

Other characteristics and advantages of the invention will appear more clearly and more fully on reading the description that follows of the preferred implementation variants of the device, which are given by way of non-limiting examples and with reference to the following appended drawings.

DETAILED DESCRIPTION

Figure 1:
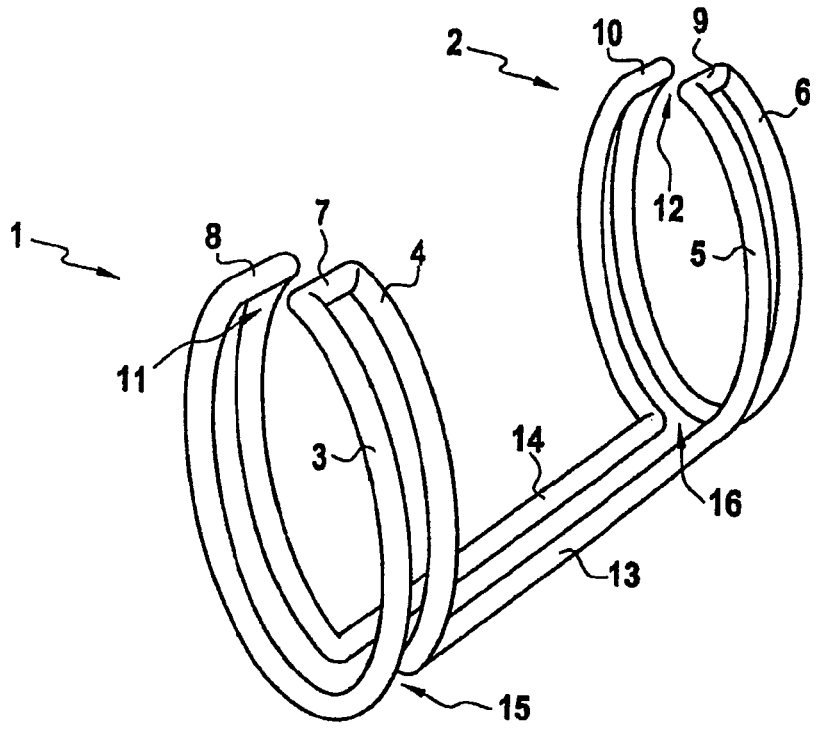
FIG. 1 diagrammatically represents a first implementation variant of the device of the invention, FIG. 2 diagrammatically represents a second implementation variant of the device of the invention, FIG. 3 diagrammatically represents a third implementation variant of the device of the invention, FIG. 4 diagrammatically represents a fourth implementation variant of the device of the invention.

As shown in the figures, the device includes two phase-shifting modules 1, 2, each consisting of two metal wires, in copper or a cuprous alloy for example, with these wires each forming a loop 3, 4, 5, 6.

These loops (namely 3 and 4 in module 1, 5 and 6 in module 2 are electrically insulated from each other, by a plastic material such as polyester for example, with the exception of two separate inter-loop connecting elements (namely 7 and 8 in module 1, and 9, 10 in module 2.

In fact, in module 1, the two loops 3, 4 are connected to each other by two separate inter-loop connecting elements 7, 8 at a first opening 11 in each of the loops 3, 4. These inter-loop connecting elements 7, 8 are advantageously formed by the wire that also constitutes the two loops 3, 4.

Similarly, in module 2, the two loops 5, 6 are connected to each other by two separate connecting elements 9, 10 at a first opening 12 in each of the loops 5, 6. These inter-loop connecting elements 7, 8 are advantageously formed by the wire that also constitutes the two loops 5, 6.

In addition, the two modules 1, 2 are connected by two separate inter-module connecting element 13, 14. Each of these inter-module connecting elements 13, 14 connects one of the loops 4 of module 1, at a second opening 15 in this loop 4, to one of the loops 5 of the other module 2 at a second opening 16 in that loop 5.

The phase-shifting modules 1, 2 are electrically insulated from each other by a plastic material such as polyester for example, with the exception of the inter-module connecting elements 13, 14.

The variant represented in FIG. 1 constitutes a device in which each module 1, 2 is composed of two loops which are substantially the same and flat, namely 3, 4 for the first, and 5, 6 for the second.

The loops, namely 3 and 4 firstly and 5 and 6 secondly, could just as easily be substantially homothetic to each other, one thus being slightly larger than the other (of the order of a few percent).

The loops of a given module are placed in two different parallel planes, but could just as easily be placed in two different planes slightly inclined in relation to each other.

Moreover, module 1 is substantially the same as module 2, but could just as easily be substantially homothetic to this module 2. In the latter case, one or both loops 5 and 6 of module 2 would be slightly larger (of the order of a few percent) than one or both loops 3 and 4 of module 1 for example.

In addition, the respective different and parallel planes of loops 3 and 4 are also different from and parallel to the respective planes, themselves different and parallel, of loops 5 and 6. However these respective different and parallel planes of loops 3 and 4 could just as easily be slightly inclined in relation to the different and parallel planes of loops 5 and 6.

Figure 2:
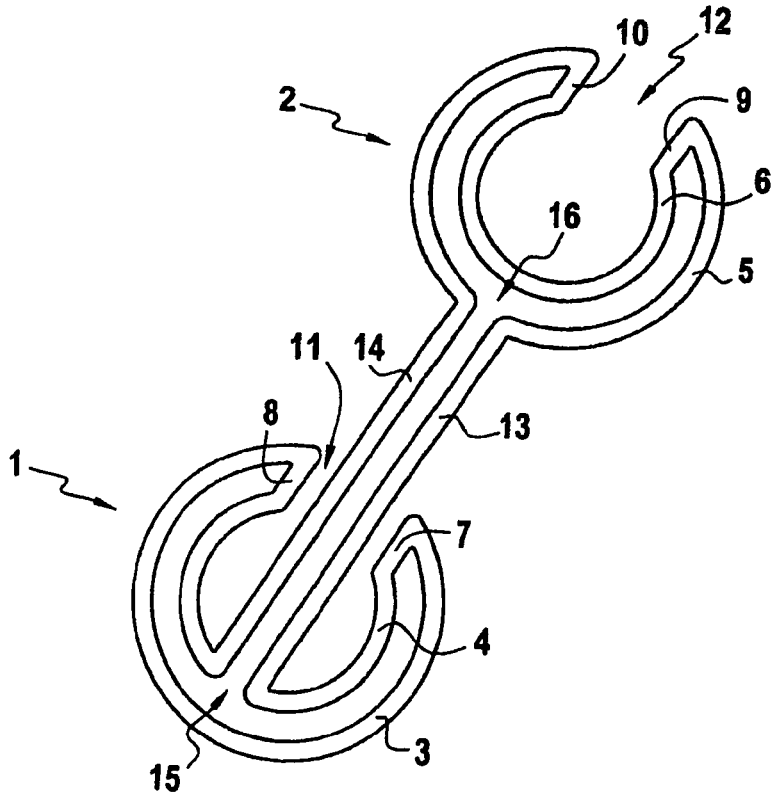

In the variant represented in FIG. 2, the entire device is located in a given plane, so that loops 3 and 4 of module 1 are in the same plane, and substantially homothetic in relation to each other. This plane is naturally also that of loops 5 and 6 of module 2, which are also substantially homothetic in relation to each other. As a consequence, in this variant, modules 1 and 2 are also located in the same plane.

In this variant, the two modules 1 and 2 are substantially the same, but could just as easily be substantially homothetic to each other. In the latter case, one or both loops 5 and 6 of module 2 would be slightly larger (of the order of a few percent) than one or both loops 3 and 4 of module 1 for example.

Figure 3:
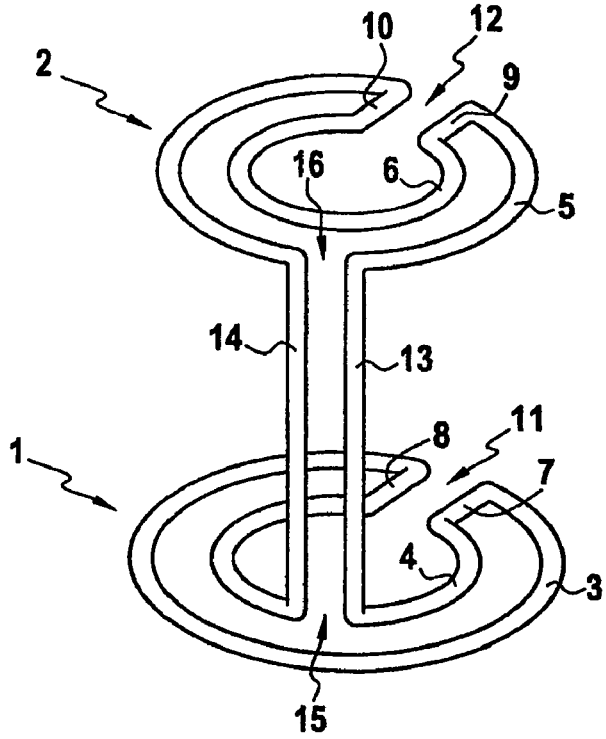

In the variant represented in FIG. 3, the loops 3 and 4 of module 1 are in a given first plane, which is therefore that of module 1, and the loops 5, and 6 of module 2 are in a given second plane, which is therefore that of module 2, different from and parallel to the first plane.

The second plane, therefore that of loops 5 and 6 of module 2, could however just as easily be slightly inclined in relation to the first plane, therefore that of loops 3 and 4 of module 1.

Moreover, all of module 2 is substantially homothetic to all of module 1, and slightly smaller to be precise. However, modules 1 and 2 could just as easily be substantially the same.

Figure 4:
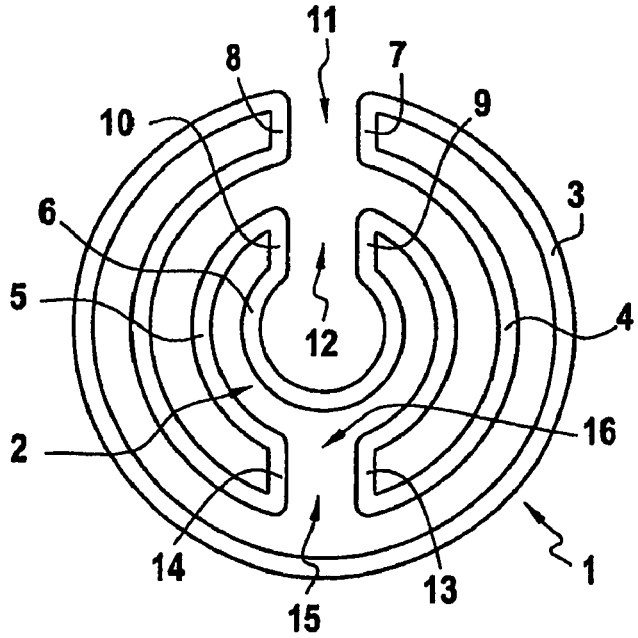

In the variant represented in FIG. 4, the entire device is located in a given plane, so that loops 3 and 4 of module 1 are in the same plane, substantially homothetic in relation to each other. This plane is naturally also that of loops 5 and 6 of module 2, which are themselves also substantially homothetic in relation to each other. As a consequence, in this variant, modules 1 and 2 are also located in the same plane, but substantially homothetic in relation to each other to the extent that module 2 is to some extent inside of module 1.

In each of the variants presented above, either after or before its final configuration, the device can be placed in an insulating polyester resin which then hardens.

In the variant presented above, the two loops of each module each has only a single turn. Possibly however, in other variants, not shown, one or more of the loops may have at least two turns placed in planes which are substantially the same or parallel.

In a particular embodiment, the loops are connected to at least one capacitor, in series and/or in parallel.

In the case of emission of medium and high-frequency waves, the device can be placed on the bottom part of an emitter such as an antenna, for example. Thus, several devices all around this emitter can be placed with the aim of providing protection around the whole periphery.

In the case of emission of low-frequency waves, the device can be used around generators of electromagnetic fields of very high power (electric power stations, electric locomotives, etc.).

More generally, the device can be installed in the generators of electromagnetic fields of medium or low power, such as electric tools (large or small), electric heaters, television sets (with the field scanning coils and the THT transformers in particular being generators of electromagnetic fields), digital alarm clocks, or mobile telephones for example.

In addition, the device can be used in the homes that are close to zones of interference coming from the ground (structural fault, water source, etc) that are also liable to generate damaging electromagnetic fields.

The applicant has observed positive effects on non-quantified symptoms, when the device is worn in direct contact with or close to a part of the human body, or even up to a few tens of meters away, depending on the exact number of phase-shifting modules in the device.

All of the above description is naturally given by way of examples only, and does not limit the invention.

In particular, as already mentioned above, the loops of given modules can be positioned in the same plane (they are then substantially homothetic in relation to each other) or in two different planes that are parallel or slightly inclined in relation to each other.

Likewise, the different modules, which are substantially homothetic or substantially the same in relation to each other, can be placed in the same plane. They can also possibly be placed in of different planes that are parallel or slightly inclined in relation to each other.

Secondly, the length of the inter-loop connecting elements firstly and inter-module elements secondly do not impose limits on the invention. This length is variable, and is adjusted in particular according to the configuration selected, and the performance objectives in terms of protection.

In addition, the two inter-loop connecting elements of a given module are presented above as being of the same length, but this does not place limits on the invention. In fact, they could just as easily be of different lengths, one being slightly longer than the other.

Likewise, the two inter-module connecting elements are presented above as being of the same length, but this does not place limits on the invention. In fact, they could just as easily be of different lengths, one being slightly longer than the other.

Finally, the precise shape of the loops places no limits on the invention, and can result in aesthetic choices other than a purely circular shape (an ellipse, a heart, etc.) for example.

The invention claimed is:

1. A multiple phase shifting device for the protection of people in relation to electromagnetic waves, wherein the device includes several phase-shifting modules, each including at least two loops which are substantially the same or homothetic to each other, substantially flat, and connected to each other electrically by two separate inter-loop connecting elements at a first opening in each of the said loops, these said loops being electrically insulated from each other with the exception of the said inter-loop connecting elements, each of the said phase-shifting modules further being connected electrically by two separate inter-module connecting elements to at least one other of the said phase-shifting modules, and being substantially the same or homothetic to the said other phase-shifting modules, the said inter-module connecting elements each connecting one of the said loops of one of the said phase-shifting modules at a second opening in this said loop, to one of the said loops of another of the said phase-shifting modules at a second opening in this said loop, the said phase-shifting modules being electrically insulated from each other with the exception of the said inter-module connecting elements.

2. The device according to claim 1, wherein the said loops of at least one of the said phase-shifting modules are placed in two different planes.

3. The device according to claim 2, wherein the said different planes are substantially parallel to each other.

4. The device according to claim 1, wherein the said loops of at least one of the said phase-shifting modules are positioned in the same plane.

5. The device according to claim 4, wherein the plane of the said loops of one of the said phase-shifting modules is the same as the plane of the said loops of another of the said phase-shifting modules.

6. The device according to claim 1, wherein the plane or planes of the loops of a phase-shifting module are different from the plane or planes of the loops of another phase-shifting module.

7. The device according to claim 6, wherein the plane or planes of the loops of a phase-shifting module are parallel to the plane or planes of the loops of another phase-shifting module.

8. The device according to claim 1, wherein each of the said loops is mounted on a flexible printed circuit and covered with a flexible insulating sheet in a polymer material.

* * * * *

UNITED STATES PATENT AND TRADEMARK OFFICE

CERTIFICATE OF CORRECTION

PATENT NO. : 7,656,361 B2
APPLICATION NO. : 11/990866
DATED : February 2, 2010
INVENTOR(S) : Abel Franco Garcia It is certified that error appears in the above-identified patent and that said Letters Patent is hereby corrected as shown below:

Title Page, insert

-- (30) Foreign Application Priority Data

Aug. 24, 2005 (FR) ..... 05 08722 --

Signed and Sealed this
Third Day of July, 2012

David J. Kappos

David J. Kappos
*Director of the United States Patent and Trademark Office*